US008631816B2

(12) United States Patent
Hsu

(10) Patent No.: US 8,631,816 B2
(45) Date of Patent: Jan. 21, 2014

(54) FAUCET STRUCTURE

(75) Inventor: Ming-Yuan Hsu, Changhua (TW)

(73) Assignee: Da Yuan Sheng Industrial Co., Ltd, Changhua (TW)

( * ) Notice: Subject to any disclaimer, the term of this patent is extended or adjusted under 35 U.S.C. 154(b) by 83 days.

(21) Appl. No.: 13/354,247

(22) Filed: Jan. 19, 2012

(65) Prior Publication Data

US 2013/0186496 A1 Jul. 25, 2013

(51) Int. Cl.

| | |
|---|---|
| ***E03C 1/04*** | (2006.01) |
| ***F15B 13/00*** | (2006.01) |
| ***F16K 5/00*** | (2006.01) |
| ***B05B 9/03*** | (2006.01) |
| ***B05B 1/30*** | (2006.01) |

(52) U.S. Cl.
USPC ..... 137/315.12; 137/801; 4/677; 239/525; 239/581.1

(58) Field of Classification Search
USPC ..... 137/315.12, 625.41, 625.4, 801; 4/675–678, 695; 239/406, 525, 581.1, 239/581.2
See application file for complete search history.

(56) References Cited

U.S. PATENT DOCUMENTS

2008/0276367 A1* 11/2008 Bares et al. ..... 4/677
2012/0018009 A1* 1/2012 Veros et al. ..... 137/454.2

* cited by examiner

*Primary Examiner* — John K Fristoe, Jr.
*Assistant Examiner* — Kevin Barss
(74) *Attorney, Agent, or Firm* — Che-Yang Chen; Law Office of Michael Chen

(57) ABSTRACT

A faucet structure includes a main body, a water collecting base, a water output head and a water control valve. The main body is tubular with thin body wall, having a receiving space that receives the water collecting base having two water inlet holes and one water outlet hole on lower portion thereof, and a water inlet channel and a water outlet channel extends from the water inlet hole and water outlet hole. A valve base is formed on sideway of the water inlet channel and the water outlet channel. The faucet includes the main body and the water collecting base respectively, so the complexity of the main body is reduced, and the manufacturing process is simplified. Also, the structure of the main body can be simplified to a thin-wall structure to reduce material and further reduce manufacturing costs.

3 Claims, 9 Drawing Sheets

B-B

FAUCET STRUCTURE

FIELD OF THE INVENTION

The present invention relates to an improved faucet structure, and more specifically to the faucet including a main body and a water collecting base respectively to reduce the complexity of the main body, and further simplify the manufacturing process. Also, the structure of the main body can be simplified to a thin-wall structure to reduce material, and further reduce manufacturing costs.

BACKGROUND OF THE INVENTION

In conventional faucets, the water output position is usually fixed and the water output distance cannot be easily adjusted, so the user can only use the containers to collect water when he/she wants to wash the floor or vegetables, which is inconvenient in use. Due to the restriction of the faucet stated above, a pullable faucet is presented. The base of the faucet body extends downwards to connect with the connecting portion and a receiving space is formed. A valve slot for water control valve is recessedly formed on an upper portion of the faucet body, and a plurality of flow holes are formed at the opening of the valve slot, and each flow hole is connected with the water inter/outlet tubes. A side tube connecting to the receiving space extends from sideway of the faucet body, and the side tube is provided for the water outlet head to plug in. The plugging end of the water outlet head has an extension tube that passes through the side tube, receiving space and connecting portion and preserves a predetermined length to connect with the water outlet tubes. So, the user can pull out the water output head to achieve the goal of extending the faucet and water output distance. However, the faucet body is preliminarily made by copper, and the valve slot and flow holes are formed by drilling the faucet body, which may waste much copper material during manufacturing process. Also, the manufacturing process becomes more complicated and is easy to fail, so the manufacturing cost is high. Also, the receiving space of the faucet body is too narrow, so it is difficult and inconvenient for the user to adjust and align water inter/outlet tubes with the flow holes of the valve slot. Moreover, the faucet body and the connecting portion are often made in one piece, it is difficult to assemble or disassemble. So, if the manufacturer wants to promote different types of faucets, the user has to change the entire set (including the faucet body and connecting portion), which is not cost-effective.

SUMMARY OF THE INVENTION

The problem to be solved in the present invention is (a) the faucet body is preliminarily made by copper, and the valve slot and flow holes are formed by drilling the faucet body, which may waste much copper material during manufacturing process. Also, the manufacturing process becomes more complicated and is easy to fail, so the manufacturing cost is high; (b) the receiving space of the faucet body is too narrow, so it is difficult and inconvenient for the user to adjust and align water inter/outlet tubes with the flow holes of the valve slot; and (c) the faucet body of the faucet and the connecting portion are often made in one piece, it is difficult to assemble or disassemble. So, if the manufacturer wants to promote different types of faucets, the user has to change the entire set (including the faucet body and connecting portion), which is not cost-effective.

To solve the problems illustrated above, the present invention provides includes a main body, a water collecting base, a water output head and a water control valve. The main body is tubular with thin body wall, having a receiving space with a downward opening. An engaging post is protrudingly formed on both sides of the opening of the receiving space, and a plugging slot is formed on top of the main body, and the plugging slot connects with a water outlet channel having a plugging opening at the opening thereof. Also, a receiving tube extends from sideway of the main body. The water collecting base has a base that has a recessed opening on one side, and a through hole is formed on both sides of the recessed opening, and the through hole has a locking unit to lock the engaging post of the main body. Two water inlet holes are formed on the lower portion of the base, and a water outlet hole is formed between two water inlet holes. Each water inlet hole and water outlet hole are provided for a water inlet connecting tube and a water outlet connecting tube, and the water inlet holes and water outlet hole extend upwards to form a water inlet channel and a water outlet channel. A valve base is formed on the sideway of the water inlet channel and the water outlet channel, and two positioning holes are recessedly formed on the valve base. The valve base also has three flow holes, each of which is connected with the water inlet channel and the water outlet channel. The water output head is disposed at the plugging opening of the water outlet channel, and a bendable extension tube is formed at the rear end of the output head. The rear end of the extension tube passes through the water outlet channel of the main body, the recessed opening of the water collecting base and the plugging slot to connect with the water outlet connecting tube of the water collecting base. Also, a predetermined length of the extension tube is preserved. The water control valve is disposed in the receiving tube of the main body, and attaches to the valve base of the water collecting base. The water control valve has three openings and two positioning posts protrudingly formed on the engaging side thereof. The positioning posts plug into the positioning holes of the water collecting base, and each opening is aligned with the flow holes of the water inlet channel and the water outlet channel. A control handle is formed outside the water control valve to control the ratio of water input/output at each opening, and an improved faucet structure in the present invention is obtained.

Comparing with conventional faucets, the present invention is advantageous because (a) a faucet includes a main body and a water collecting base respectively, so as to reduce the complexity of the main body, and further simplify the manufacturing process. Also, the structure of the main body can be simplified to a thin-wall structure to reduce material and further reduce manufacturing costs; (b) since the water inlet connecting tube and water outlet connecting tube can be first connected to the water collecting base, and the water collecting base can slide along the restricting rib of the main body through the restricting wing to form a preliminary positioning, so as to avoid interference regarding connections if the receiving space of the main body is too narrow, to achieve the goal of easy installation and assembly; and (c) since the main body and the connecting body can be assembled/disassembled, the user can only replace the main body when necessary without replacing the connecting body, which is more cost-effective for the user.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
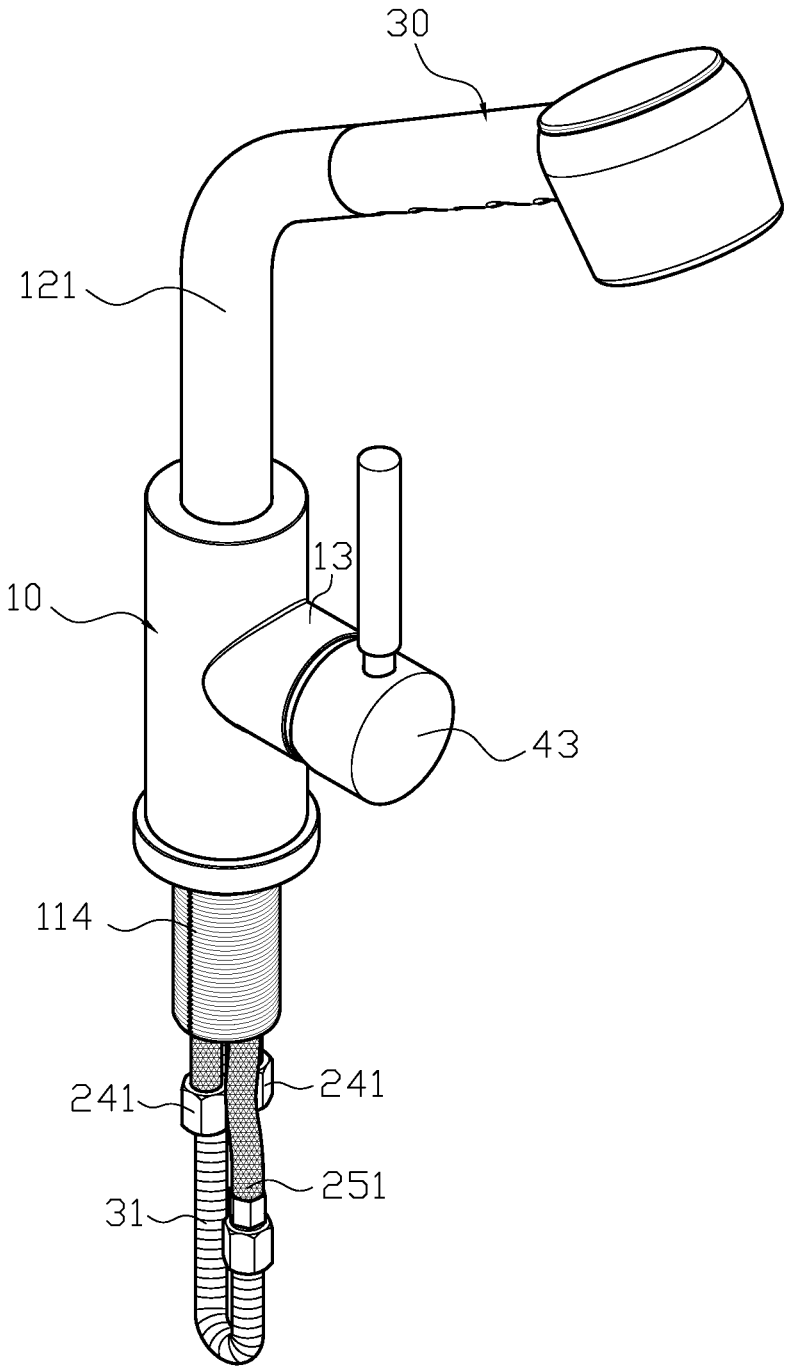
FIG. 1 illustrates a three-dimensional assembled view in the present invention.
Figure 2:
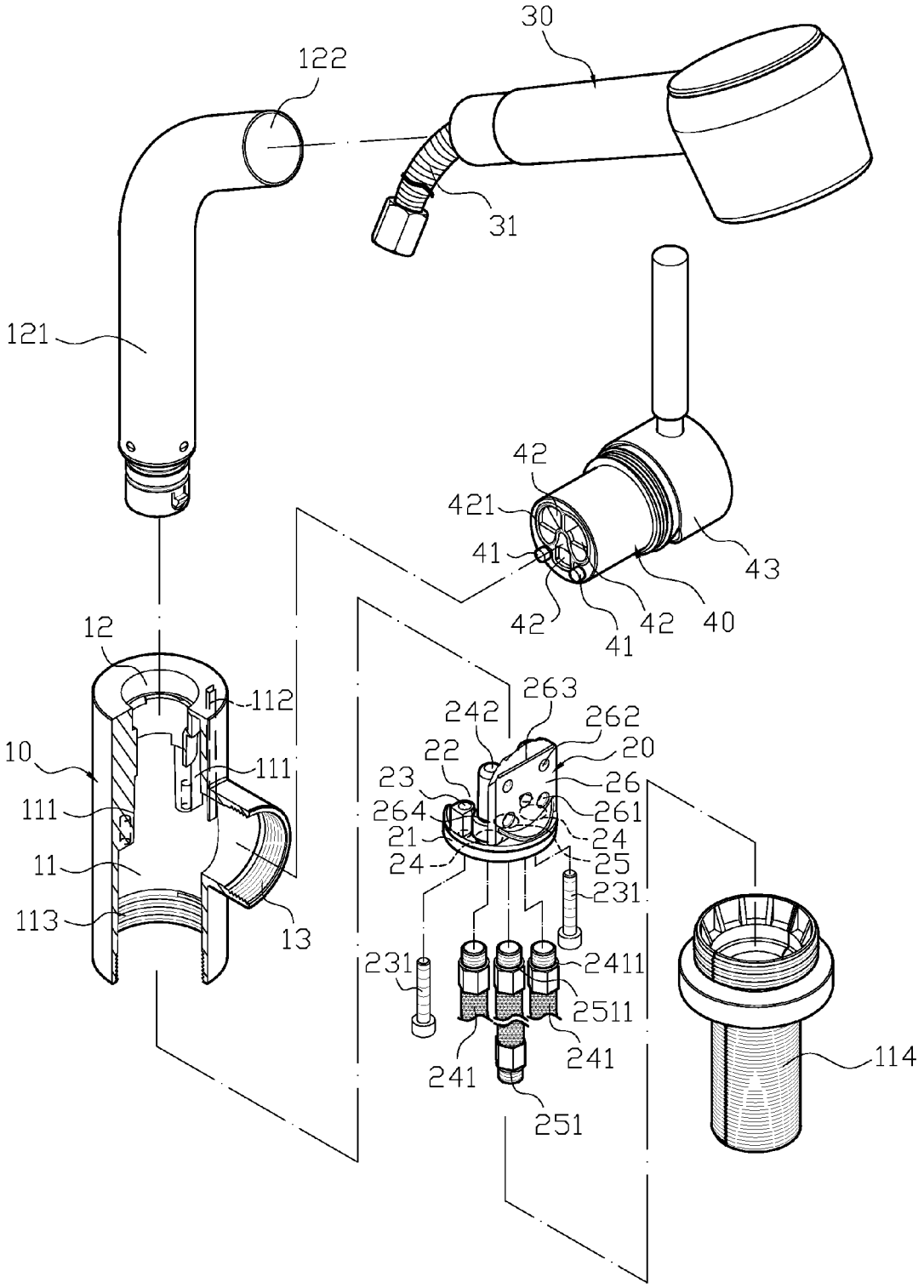
FIG. 2 illustrates a three-dimensional exploded view in the present invention.
Figure 3:
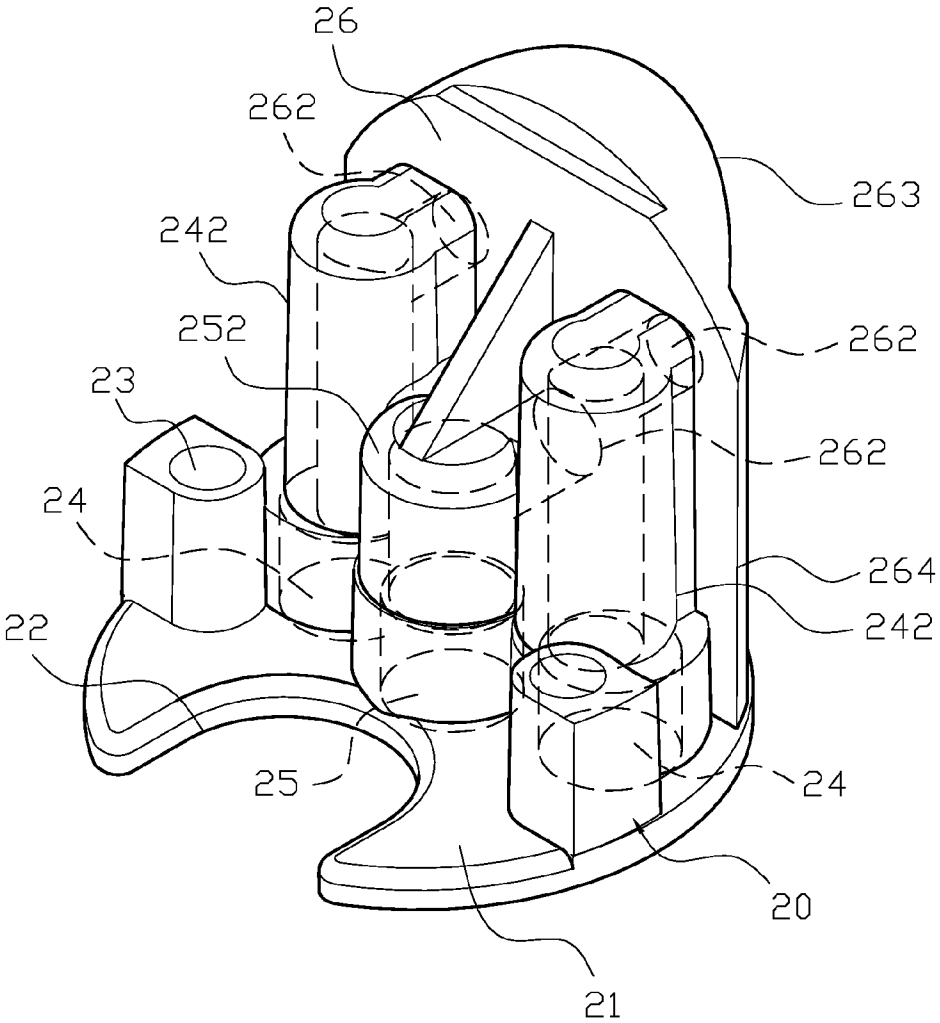
FIG. 3 illustrates a schematic view of another angle if the water collecting base in the present invention.

In order to further understand the goal, characteristics and effect of the present invention, a number of embodiments along with the drawings are illustrated as following:

Referring to FIGS. 1 to 3, a faucet structure includes a main body (10), a water collecting base (20), a water output head (30) and a water control valve (40). The main body (10) is tubular with thin body wall, having a receiving space (11) with a downward opening. An engaging post (111) is protrudingly formed on both sides of the opening of the receiving space (11), and a restricting rib (112) is protrudingly formed near the engaging post (111). A thread section (113) is disposed at the opening of the receiving space (11), so that the thread section (113) has a connecting tube body (114). A plugging slot (12) is formed on top of the main body (10), and the plugging slot (12) connects with a water outlet tube (121) having a plugging opening (122) at the opening thereof. Also, a receiving tube (13) extends from sideway of the main body (10). The water collecting base (20) has a base (21) that has a recessed opening (22) on one side, and a through hole (23) is formed on both sides of the recessed opening (22), and the through hole (23) has a locking unit (231) to lock the engaging post (111) of the main body (10). Two water inlet holes (24) are formed on the lower portion of the base (21), and a water outlet hole (25) is formed between two water inlet holes (24). Each water inlet hole (24) and water outlet hole (25) are provided for a water inlet connecting tube (241) and a water outlet connecting tube (251), and an anti-leaking gasket (2411) (2511) is disposed at an engaging end. The water inlet holes (24) and water outlet hole (25) extend upwards to form a water inlet channel (242) and a water outlet channel (252). A valve base (26) is formed on the sideway of the water inlet channel (242) and the water outlet channel (252), and two positioning holes (261) are recessedly formed on the valve base (25). The valve base (26) also has three flow holes (262), each of which is connected with the water inlet channel (242) and the water outlet channel (252). A protruding edge (263) is each formed on an upper and lower edge of the valve base (26), and the protruding edge (263) has a restricting wing (264) on both sides against the restricting rib (112) of the main body (10) to form a restricting position. The water output head (30) is disposed at the plugging opening (122) of the water outlet tube (121), and a bendable extension tube (31) is formed at the rear end of the output head (30). The rear end of the extension tube (31) passes through the water outlet tube (121) of the main body (10), the recessed opening (22) of the water collecting base (20) and the plugging slot (12) to connect with the water outlet connecting tube (251) of the water collecting base (20). A predetermined length of the extension tube (31) is preserved. The water control valve (40) is disposed in the receiving tube (13) of the main body (10), and wedged at the protruding edge (263) of the water collecting base (20), so as to engage with each other and attach to the valve base (26) of the water collecting base (20). The water control valve (40) has two positioning posts (41) protrudingly formed on the engaging side thereof, and three openings (42). The positioning posts (41) plug into the positioning holes (261) of the water collecting base (20), and each opening (42) is aligned with the flow holes (262) of the water inlet channel (242) and the water outlet channel (252). A sealing unit (421) is formed between the the water control valve (40) and the valve base (26) of the water collecting base (20), and a control handle (43) is formed outside the water control valve (40) to control the ratio of water input/output at each opening (42).

Figure 4:
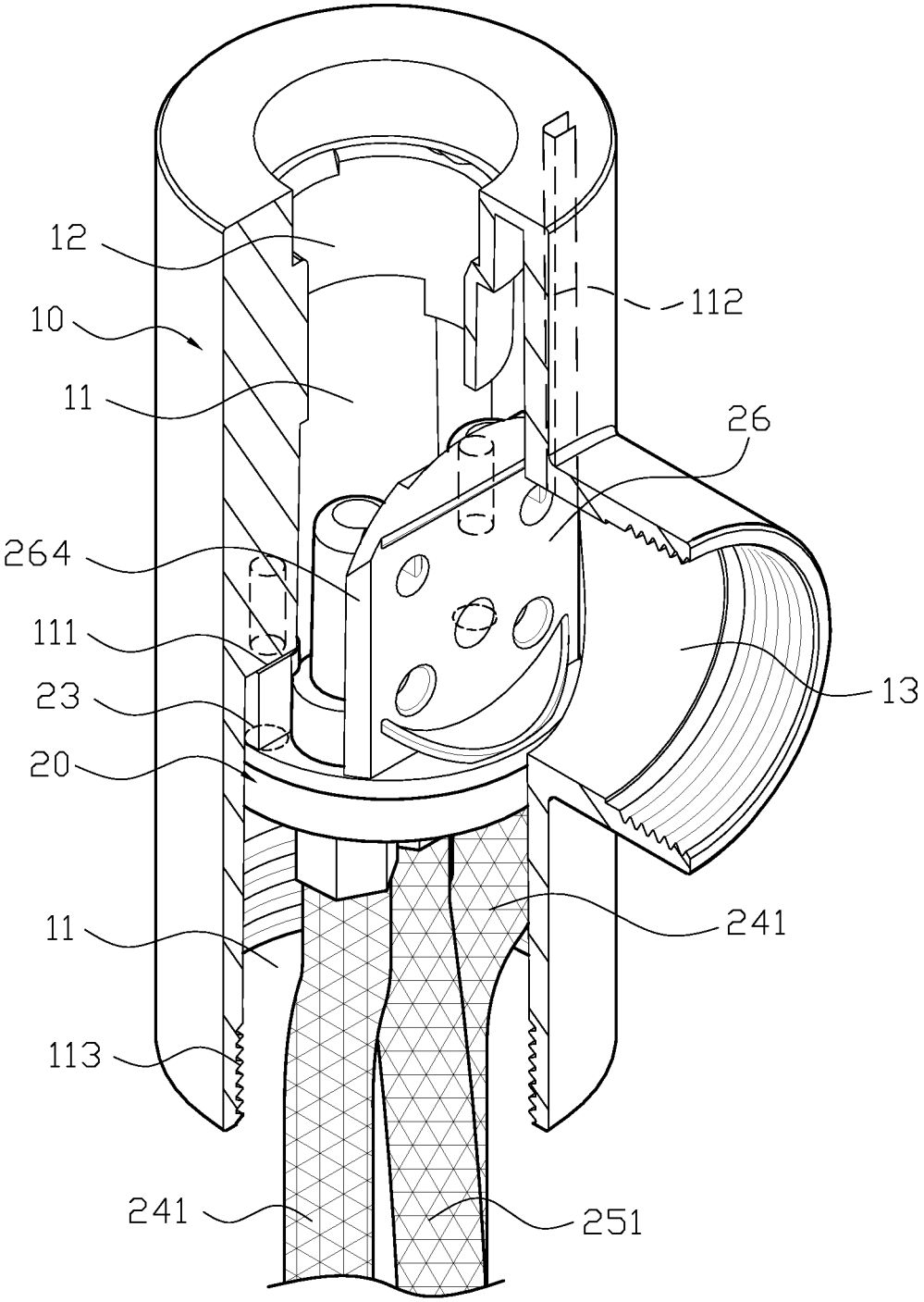
FIG. 4 illustrates a three-dimensional sectional view in the present invention.
Figure 5:
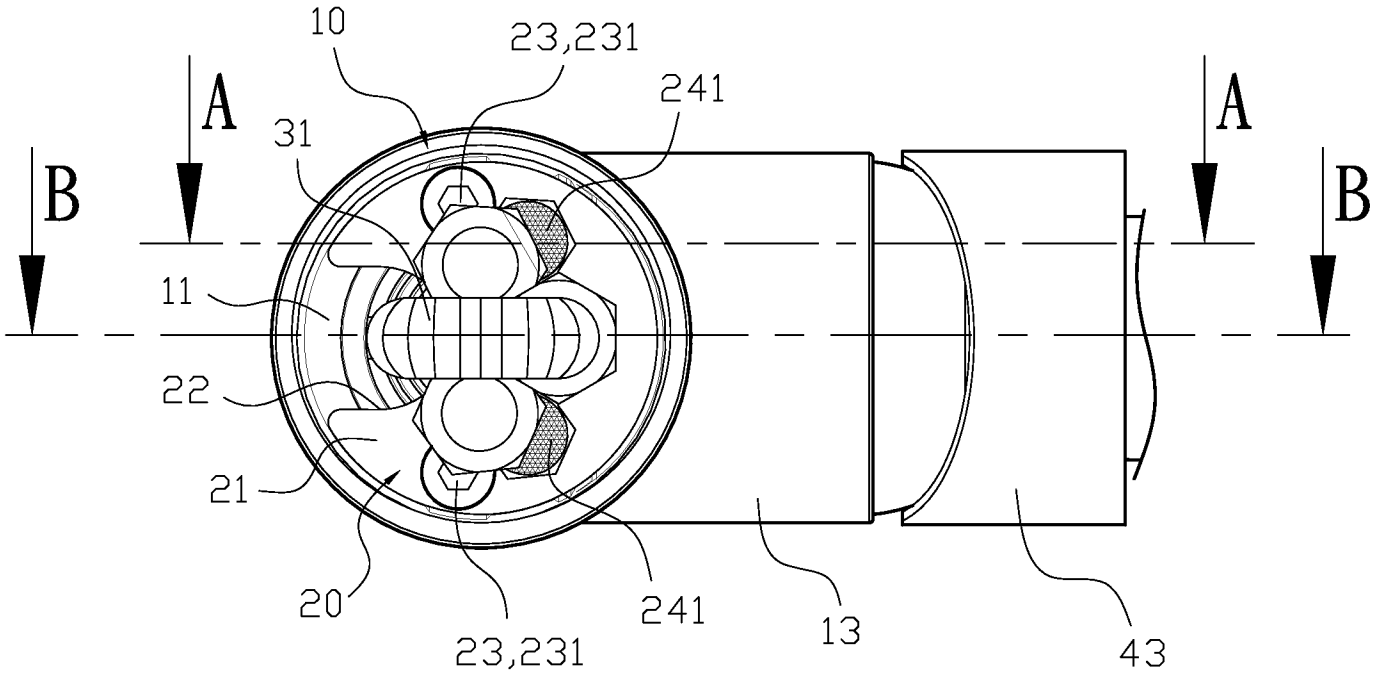
FIG. 5 illustrates a schematic sectional view in the present invention.

Referring to FIGS. 2, 4 and 5 for the structure, the water inlet connecting tube (241) and water outlet connecting tube (251) are connected with the water inlet holes (24) and the water outlet hole (25), and the water collecting base (20) is disposed into the receiving space (11) of the main body (10). At this time, since the water collecting base (20) has two restricting wings (264) on both sides, it can slide along the restricting rib (112) of the main body (10), so that the through hole (23) of the water collecting base (20) can align with the engaging post (111) of the main body (10) to form a preliminary positioning (see FIG. 4 as well). Furthermore, the locking unit (231) can be passed through to form a secure positioning to achieve the goal of easy installation and assembly. Also, the water control valve (40) is disposed into the receiving tube (13) of the main body (10), and is engaged with the protruding edge (263) of the water collecting base (20), so as to engage and attach to the valve base (26) of the water collecting base (20). The positioning posts (41) plug into the positioning holes (261) of the water collecting base (20), so that each opening (42) of the water control valve (40) is aligned with the flow holes (262) of the water inlet channel (242) and the water outlet channel (252). Next, the water output head (30) is disposed at the opening of the water outlet tube (121), and one end of the extension tube (31) passes through the water outlet tube (121) of the main body (10), the recessed opening (22) of the water collecting base (20) and the plugging slot (12) to connect with the water outlet connecting tube (251) of the water collecting base (20), and a predetermined length of the extension tube (31) is preserved to complete the assembly process. In the present invention, a faucet includes a main body (10) and a water collecting base (20), so as to reduce the complexity of the main body (10), and further simplify the manufacturing process. Also, the structure of the main body (10) can be simplified to a thin-wall structure to reduce material and further reduce manufacturing costs. On the other hand, since the main body (10) and the connecting body (114) can be assembled/disassembled, the user can only replace the main body (10) when necessary without replacing the connecting body (114), which is more cost-effective for the user.

Figure 6:
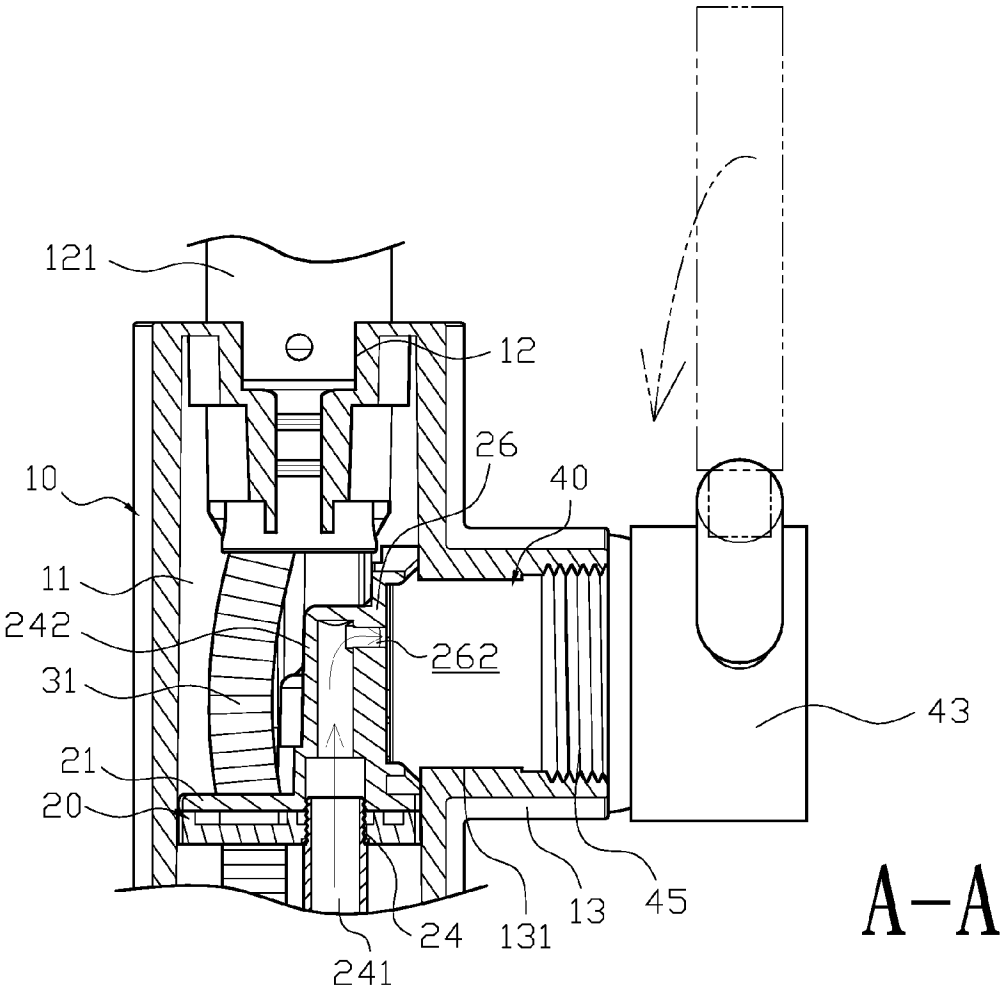
FIG. 6 illustrates a schematic sectional view in FIG. 5 along line A-A in the present invention.
Figure 7:
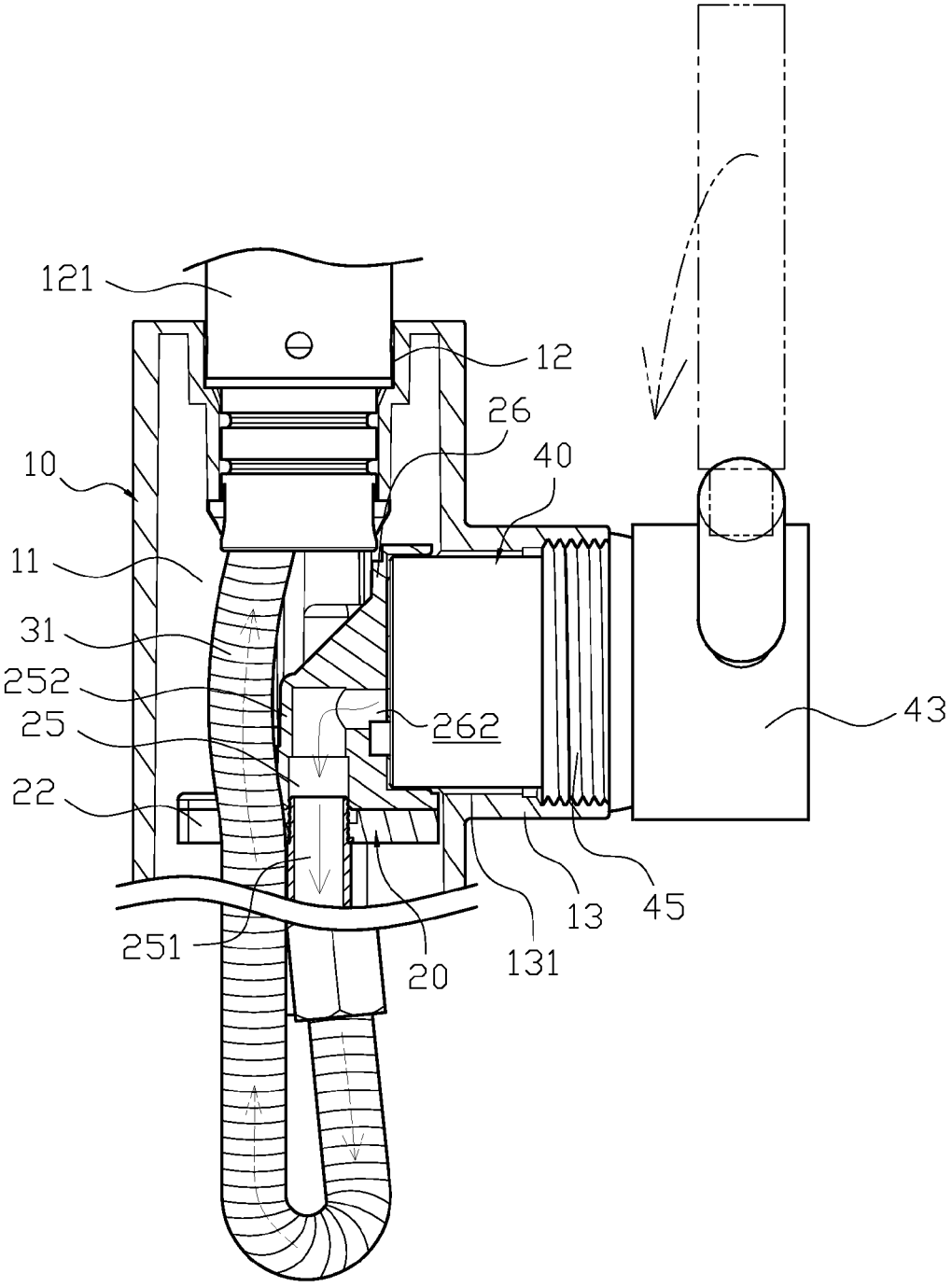
FIG. 7 illustrates a schematic sectional view in FIG. 5 along line B-B in the present invention.
Figure 8:
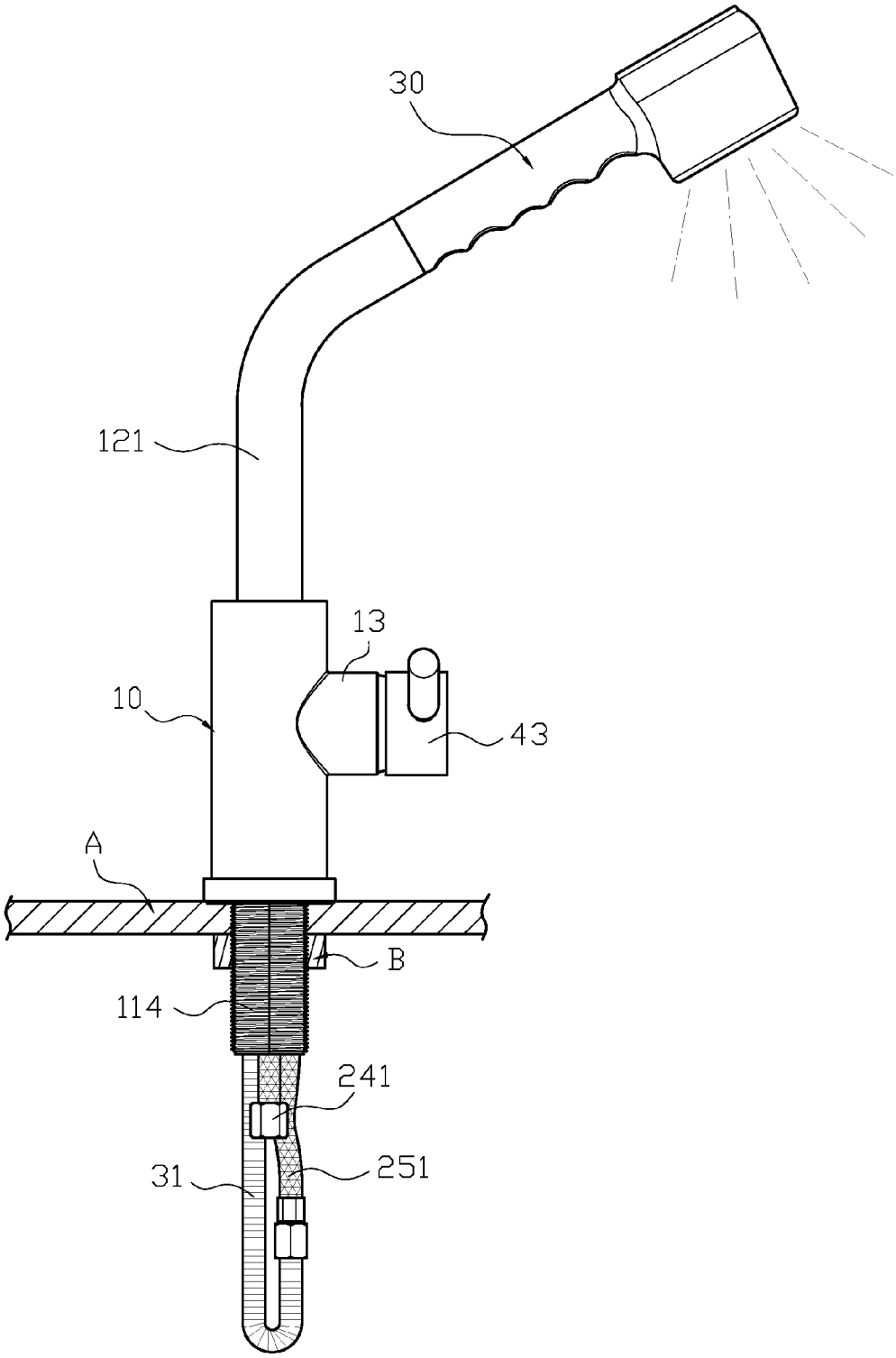
FIG. 8 illustrates a schematic view of the water output head to form a water output status.
Figure 9:
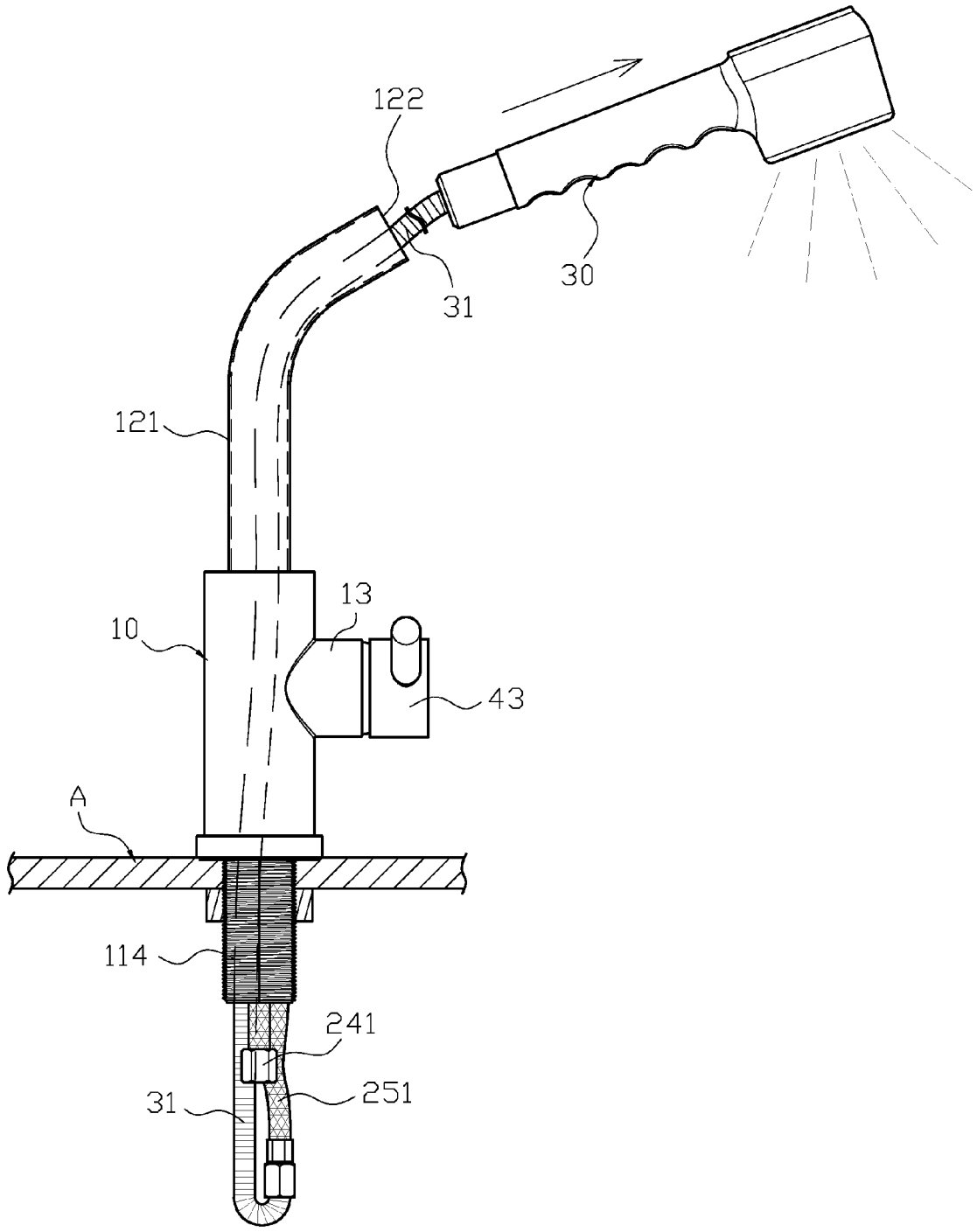
FIG. 9 illustrates a schematic view of the water output head pulled away from the water outlet channel.

Referring to FIGS. 2, 6 and 7 for practical use of the present invention, the main body (10) is connected with the connecting body (114) and disposed on a surface (A) of a washbasin or sink, and a screw (B) locks the connecting body (114) to form a secure positioning. The water inlet connecting tubes (241) of the water collecting base (20) is connected to the water source. When the user rotates the handle (43) of the water control valve (40), the water flows from the water inlet holes (24) of the water collecting base (20) and the water inlet channel (242) to the openings (42) of the water control valve (40). The water then flows from the water control valve (40), the flow holes (262) of the water outlet channel (252) and water outlet connecting tube (251), to the extension tube (31) and the water output head (30) to output the water (see FIG. 8 as well). FIG. 9 illustrates that the user wants to extend the distance of water output from the faucet. Since the water output head (30) and the main body (10) are separable, the water outlet head (30) can be detached from the plugging opening (122) of the water outlet tube (121) of the main body (10). Furthermore, since there is a predetermined length at the junction of the extension tube (31) of the water output head (30) and the water outlet connecting tube (251), the user can pull out the water output head (30) to achieve the goal of extending the water output distance, which is more convenient for the user to use the faucet.

According to the embodiments discussed above, the present invention has the following advantages: (a) a faucet includes a main body (10) and a water collecting base (20) respectively, so as to reduce the complexity of the main body (10), and further simplify the manufacturing process. Also, the structure of the main body (10) can be simplified to a thin-wall structure to reduce material and further reduce manufacturing costs; (b) since the water inlet connecting tube (241) and water outlet connecting tube (251) can be first connected to the water collecting base (20), and the water collecting base (20) can slide along the restricting rib (112) of the main body (10) through the restricting wing (264) to form a preliminary positioning, so as to avoid interference regarding connections if the receiving space (11) of the main body (10) is too narrow, to achieve the goal of easy installation and assembly; and (c) since the main body (10) and the connecting body (114) can be assembled/disassembled, the user can only replace the main body (10) when necessary without replacing the connecting body (114), which is more cost-effective for the user.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A faucet structure, comprising:

a main body, which is tubular with thin body wall, having a receiving space with a downward opening, and an engaging post is protrudingly formed on both sides of an opening of the receiving space, wherein a plugging slot is recessedly formed on an upper portion of the main body, and the plugging slot is connected with a water outlet tube having a plugging opening at an opening end of the water outlet tube, and a receiving tube is formed on sideway of the main body;

a water collecting base, having a base that has a recessed opening on one side, and a through hole formed on both sides of the recessed opening, the through hole having a locking unit to lock the engaging post of the main body, wherein two water inlet holes are formed on a lower portion of the base, and a water outlet hole is formed between two water inlet holes, and each water inlet hole and water outlet hole are provided for a water inlet connecting tube and a water outlet connecting tube respectively to connect, wherein each water inlet hole and water outlet hole extend upwards to form a water inlet channel and a water outlet channel, and a valve base is formed on sideway of the water inlet channel and the water outlet channel, wherein two positioning holes are recessedly formed on the valve base, while three flow holes are disposed thereon, each of which is connected with the water inlet channel and the water outlet channel;

a water output head, disposed at the plugging opening of the water outlet tube, and a extension tube connected at a rear end of the water output head, wherein the extension tube passes through the water outlet tube of the main body, the recessed opening of the water collecting base and the plugging slot to connect with the water outlet connecting tube of the water collecting base, and a predetermined length of the extension tube is preserved; and a water control valve, disposed in the receiving tube of the main body and attached to the valve base of the water collecting base, having two positioning posts protrudingly formed on one side thereof, and three openings, wherein the positioning posts plug into the positioning holes of the water collecting base, and each opening is aligned with the flow holes of the water inlet channel and the water outlet channel, wherein a control handle is used to control the ratio of water input/output at each opening, wherein a restricting rib is protrudingly formed near the engaging post, and a restricting wing is formed on both sides of the valve base of the water collecting base, and the restricting wing is able to slide along the restricting rib of the main body, so that the through hole of the water collecting base is able to align with the engaging post of the main body to form a preliminary positioning.

2. The faucet structure of claim 1, wherein a detachable connecting body is formed at an opening edge of the receiving space of the main body.

3. The faucet structure of claim 1, wherein a protruding edge is each formed on an upper and lower edge of the valve base, and the water control valve is wedged at the protruding edge of the water collecting base, so as to engage with each other and attach to the valve base of the water collecting base.

* * * * *